US012247762B2

(12) United States Patent
Liu et al.

(10) Patent No.: US 12,247,762 B2
(45) Date of Patent: Mar. 11, 2025

(54) AIR GUIDE STRUCTURE AND FAN HEATER

(71) Applicant: Shenzhen Hesung Innovation Technology Co., LTD, Guangdong (CN)

(72) Inventors: Ailong Liu, Guangdong (CN); Hongli Xiao, Guangdong (CN); Xianglu Dai, Guangdong (CN); Aimin He, Guangdong (CN)

(73) Assignee: Shenzhen Hesung Innovation Technology Co., LTD, Shenzhen (CN)

( * ) Notice: Subject to any disclaimer, the term of this patent is extended or adjusted under 35 U.S.C. 154(b) by 0 days.

(21) Appl. No.: 18/320,898

(22) Filed: May 19, 2023

(65) Prior Publication Data

US 2024/0219072 A1 Jul. 4, 2024

(30) Foreign Application Priority Data

Dec. 29, 2022 (CN) ..... 202223539138.8

(51) Int. Cl.

| | |
|---|---|
| ***F04D 29/54*** | (2006.01) |
| ***F04D 19/00*** | (2006.01) |
| ***F24H 3/04*** | (2022.01) |
| ***F24H 9/00*** | (2022.01) |

(52) U.S. Cl.

CPC ..... *F24H 9/0063* (2013.01); *F04D 19/002* (2013.01); *F04D 29/542* (2013.01); *F24H 3/04* (2013.01)

(58) Field of Classification Search

CPC .... F04D 19/002; F04D 29/542; F24H 9/0063; F24H 3/04

See application file for complete search history.

(56) References Cited

U.S. PATENT DOCUMENTS 3,883,264 A * 5/1975 Rao ..... F04D 29/544 415/209.1
4,548,548 A * 10/1985 Gray, III ..... F04D 29/544 416/189
6,427,763 B2 * 8/2002 Matsumoto ..... H01L 23/467 257/E23.099
6,524,067 B1 * 2/2003 Chen ..... F04D 29/545 416/247 R (Continued)

FOREIGN PATENT DOCUMENTS

TW M448889 U * 3/2013
WO WO-2010022591 A1 * 3/2010 ..... F04D 29/542

*Primary Examiner* — David E Sosnowski
*Assistant Examiner* — Wayne A Lambert
(74) *Attorney, Agent, or Firm* — ArentFox Schiff LLP

(57) ABSTRACT

An air guide structure is disposed between an axial flow fan and a heating body. The air guide structure includes a frame body and at least three air guide vanes, and the air guide vanes are arranged in an annular array on the frame body. A curved surface or multiple planar surfaces are provided between an air guide vane leading edge and an air guide vane trailing edge for transition between the air guide vane leading edge and the air guide vane trailing edge, the air guide vane leading edge is parallel to an incoming flow direction of the axial flow fan, and the air guide vane trailing edge is parallel to an air outlet channel of the heating body. A fan heater includes an axial flow fan, a heating body, and the air guide structure.

16 Claims, 11 Drawing Sheets

(56) References Cited

U.S. PATENT DOCUMENTS 6,997,678 B2 * 2/2006 Sun ..... F04D 29/541 415/220
7,117,932 B2 * 10/2006 Ku ..... H01L 23/467 257/E23.099
7,334,988 B2 * 2/2008 Horng ..... F04D 29/544 415/211.2
7,429,162 B2 * 9/2008 Lee ..... F04D 25/0613 415/220
7,866,945 B2 * 1/2011 Ishihara ..... F04D 29/325 416/247 R
8,035,967 B2 * 10/2011 Oh ..... F04D 25/0613 415/208.1
2002/0159883 A1 * 10/2002 Simon ..... F04D 29/703 415/209.1
2003/0007867 A1 * 1/2003 Chang ..... H01L 23/467 257/E23.099
2003/0136546 A1 * 7/2003 Zhang ..... H01L 23/467 257/E23.099
2003/0178180 A1 * 9/2003 Chang ..... H01L 23/467 165/185
2004/0201961 A1 * 10/2004 Ko ..... F04D 29/545 361/679.48
2004/0265123 A1 * 12/2004 Chang ..... F04D 29/542 415/211.2
2005/0089402 A1 * 4/2005 Horng ..... F04D 25/0613 415/186
2006/0139881 A1 * 6/2006 Jan ..... H01L 23/467 257/E23.099
2007/0237656 A1 * 10/2007 Pipkorn ..... F04D 29/542 417/366
2008/0107524 A1 * 5/2008 Chang ..... F04D 25/082 415/220
2009/0101315 A1 * 4/2009 Cheng ..... F04D 29/582 165/104.31

* cited by examiner

AIR GUIDE STRUCTURE AND FAN HEATER

CROSS-REFERENCE TO RELATED APPLICATION(S)

This application claims priority to Chinese Patent Application No. 202223539138.8 filed Dec. 29, 2022, the disclosure of which is incorporated herein by reference in its entirety.

TECHNICAL FIELD

The present disclosure relates to the technical field of fan heaters, and in particular, to an air guide structure and a fan heater.

BACKGROUND

At present, the air blown out by the fan of an existing fan heater is the rotating columnar air, and heat dissipation fins of the heating body are parallel to the axis of the fan. After the rotating air hits the fins of the heating body, large part of the columnar air will be lost, resulting in a relatively low air outlet speed of the whole machine, a relatively short hot air blowing distance and a small effective heating range. Moreover, with the increase of the power of the fan, the volume of the rotating outlet air increases greatly, and after the rotating air hits the heating body, a large number of vortexes are generated, resulting in a significant increase in the noise of the whole machine, and thus affecting the user experience.

Therefore, an air guide structure and a fan heater are required to solve the preceding problems.

SUMMARY

The present disclosure provides an air guide structure and a fan heater so that the air outlet speed of the fan heater can be effectively improved, the noise of the whole machine is reduced, moreover, the air outlet uniformity is improved, and thus the situation where the local temperature is too high is avoided.

The present disclosure adopts technical solutions described below.

In one aspect, the present disclosure provides an air guide structure. The air guide structure includes a frame body and at least three air guide vanes.

The at least three air guide vanes are arranged in an annular array, each air guide vane includes a fixed end, an extended end, an air guide vane leading edge and an air guide vane trailing edge, the fixed end is disposed on an inner side wall of the frame body, the extended end extends along a first arc to a central axis of the frame body, a curved surface or multiple sections of planar surfaces are provided between the air guide vane leading edge and the air guide vane trailing edge for transition between the air guide vane leading edge and the air guide vane trailing edge, the air guide vane leading edge is parallel to an incoming flow direction of an axial flow fan, the air guide vane trailing edge is parallel to an air outlet channel of a heating body, and the air guide vane leading edge is inclined to one side relative to the air guide vane trailing edge.

Optionally, the air guide structure includes a central shaft, and the extended end of each air guide vane is connected to the central shaft.

Optionally, the air guide structure includes an inner air guide ring, and the extended end of each air guide vane is connected to the inner air guide ring.

Optionally, the inner air guide ring includes an inner air guide ring leading edge and an inner air guide ring trailing edge, and a curved surface or a planar surface is provided between the inner air guide ring leading edge and the inner air guide ring trailing edge for transition between the inner air guide ring leading edge and the inner air guide ring trailing edge.

Optionally, the air guide structure includes a middle air guide ring, and the middle portion of each air guide vane is connected to the middle air guide ring.

Optionally, the middle air guide ring includes a middle air guide ring leading edge and a middle air guide ring trailing edge, and a curved surface or a planar surface is provided between the middle air guide ring leading edge and the middle air guide ring trailing edge for transition between the middle air guide ring leading edge and the middle air guide ring trailing edge.

Optionally, the frame body includes an air guide surface, the air guide surface is disposed as a planar surface or a curved surface, and an air outlet end of the air guide surface is parallel to the air outlet channel of the heating body.

In another aspect, the present disclosure provides a fan heater. The fan heater includes an axial flow fan, a heating body and the air guide structure in any one of the preceding solutions. The air guide structure is disposed between the axial flow fan and the heating body.

Optionally, the axial flow fan includes a mounting frame and a fan. The fan includes a fixed ring and multiple fan blades disposed on the fixed ring, the multiple fan blades extend along a second arc to the outside of the fixed ring, and a convex direction of the second arc is opposite to a convex direction of the first arc.

Each fan blade includes a fan blade leading edge and a fan blade trailing edge, the fan blade leading edge is inclined to one side relative to the fan blade trailing edge, and an inclination direction of the fan blade leading edge relative to the fan blade trailing edge is opposite to an inclination direction of the air guide vane leading edge of each air guide vane of the air guide structure relative to the air guide vane trailing edge of each air guide vane of the air guide structure.

Optionally, one side of the frame body of the air guide structure is disposed against the axial flow fan, the frame body is sealingly connected to the axial flow fan, the other side of the frame body is disposed against the heating body, and the frame body is sealingly connected to the heating body.

The present disclosure provides an air guide structure. The air guide structure is disposed between an axial flow fan and a heating body. The air guide structure includes a frame body and at least three air guide vanes, and the at least three air guide vanes are arranged in an annular array on an inner side wall of the frame body. Each air guide vane includes a fixed end, an extended end, an air guide vane leading edge and an air guide vane trailing edge. The fixed end is disposed on the inner side wall of the frame body, the extended end extends along a first arc to a central axis of the frame body, a curved surface or multiple sections of planar surfaces are provided between the air guide vane leading edge and the air guide vane trailing edge for transition between the air guide vane leading edge and the air guide vane trailing edge, the air guide vane leading edge is parallel to an incoming flow direction of the axial flow fan, and the air guide vane trailing edge is parallel to an air outlet channel of the heating body. Through the air guide structure, the rotating part of the air blown out by the axial flow fan can be changed, and the rotating air originally having an included angle with the axis of the axial flow fan is corrected into the air approximately parallel to the axis of the axial flow fan, so that it is ensured that more than 90% of the air blown out by the axial flow fan can be blown to the outside of the fan heater, the air outlet volume of the whole machine is improved, the air speed is relatively high, and the heating effect is good.

The present disclosure further provides a fan heater. The fan heater includes an axial flow fan, a heating body and the preceding air guide structure. The air guide structure is disposed between the axial flow fan and the heating body. The air guide structure can guide the rotating air generated by the axial flow fan to a right direction, thereby reducing the rotational speed component of the rotating air. Therefore, the air outlet distance, the air outlet speed and the air outlet volume are improved, the noise is relatively low, and the heating effect is good.

BRIEF DESCRIPTION OF DRAWINGS

Drawings used in description of the embodiments of the present disclosure are briefly described below. Apparently, the drawings described below illustrate only part of the embodiments of the present disclosure, and those of ordinary skill in the art may obtain other drawings based on the content of the embodiments of the present disclosure and the drawings described below on the premise that no creative work is done.

REFERENCE LIST

Figure 1:
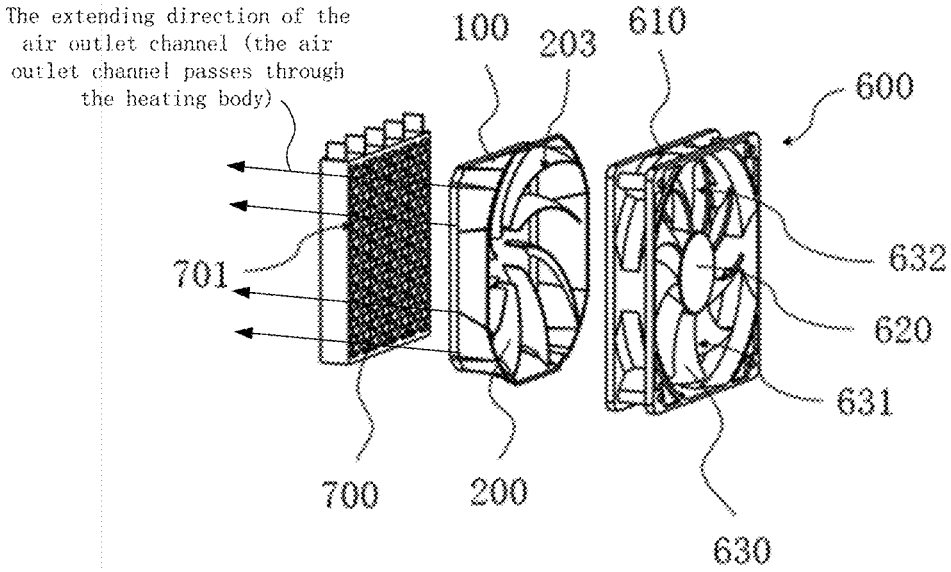
FIG. 1 is a structural view of a fan heater according to embodiment one of the present disclosure.

100 frame body
101 air guide surface
200 air guide vane
201 fixed end
202 extended end
203 air guide vane leading edge
204 air guide vane trailing edge
300 central shaft
400 inner air guide ring
401 inner air guide ring leading edge
402 inner air guide ring trailing edge
500 middle air guide ring
501 middle air guide ring leading edge
502 middle air guide ring trailing edge
600 axial flow fan
610 mounting frame
620 fixed ring
630 fan blade
631 fan blade leading edge
632 fan blade trailing edge
700 heating body
701 air outlet channel

DETAILED DESCRIPTION

The present disclosure is further described below in detail in conjunction with drawings and embodiments. It is to be understood that the specific embodiments set forth below are intended to merely illustrate and not to limit the present disclosure. In addition, it is to be noted that for ease of description, only part, not all, of structures related to the present disclosure are illustrated in the drawings.

In the description of the present disclosure, unless otherwise expressly specified and limited, the term "connected to each other", "connected" or "fixed" is to be construed in a broad sense, for example, as fixedly connected, detachably connected or integrated; mechanically connected or electrically connected; directly connected to each other or indirectly connected to each other via an intermediary; or internally connected between two elements or interaction relations between two elements. For those of ordinary skill in the art, specific meanings of the preceding terms in the present disclosure may be understood based on specific situations.

In the present disclosure, unless otherwise expressly specified and limited, when a first feature is described as "on" or "below" a second feature, the first feature and the second feature may be in direct contact, or be in contact via another feature between the two features instead of being in direct contact. Moreover, when the first feature is described as "on", "above" or "over" the second feature, the first feature is right on, above or over the second feature, or the first feature is obliquely on, above or over the second feature, or the first feature is simply at a higher level than the second feature. When the first feature is described as "under", "below" or "underneath" the second feature, the first feature is right under, below or underneath the second feature or the first feature is obliquely under, below or underneath the second feature, or the first feature is simply at a lower level than the second feature.

In the description of the embodiments, it is to be noted that orientations or position relations indicated by terms such as "above", "below", "left" and "right" are based on the drawings. These orientations or position relations are intended only to facilitate the description and simplify the operation and not to indicate or imply that a device or element referred to must have such particular orientations or must be configured or operated in such particular orientations. Thus, these orientations or position relations are not to be construed as limiting the present disclosure. In addition, the terms "first" and "second" are used only to distinguish between descriptions and have no special meaning.

Embodiment One

Figure 2:
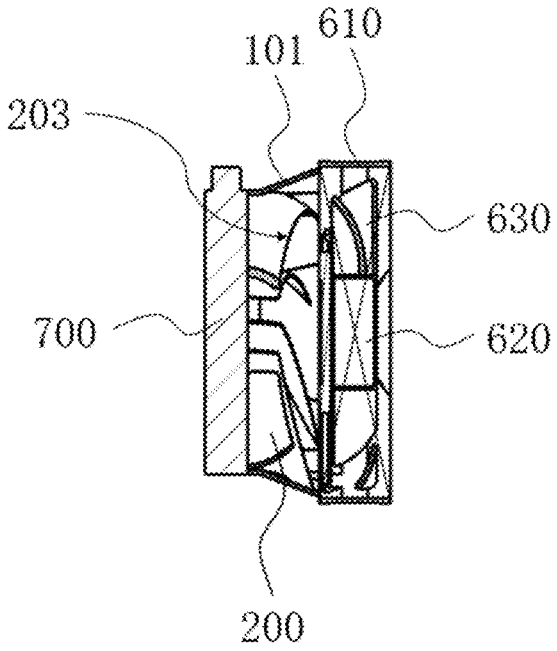
FIG. 2 is a cross-sectional view of a fan heater according to embodiment one of the present disclosure.
Figure 3:
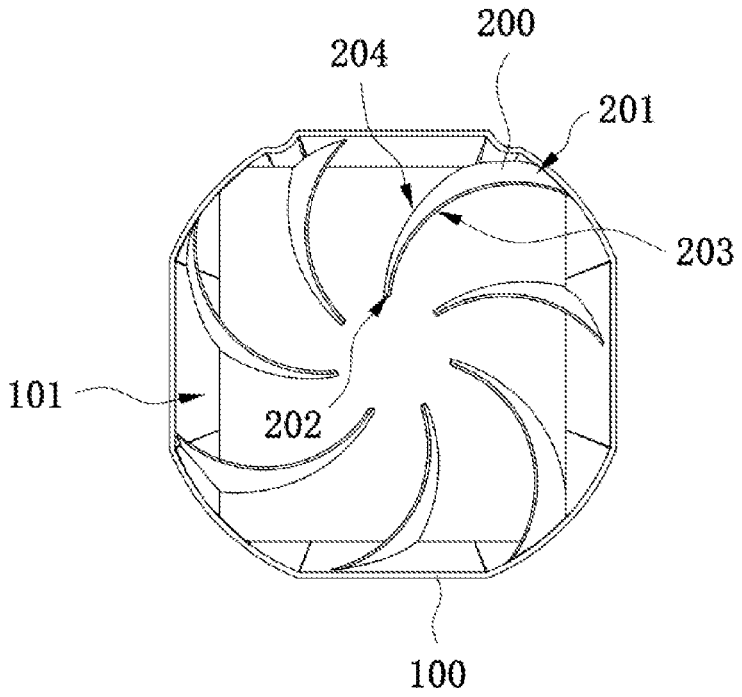
FIG. 3 is a front view of an air guide structure (having seven air guide vanes) according to embodiment one of the present disclosure.
Figure 4:
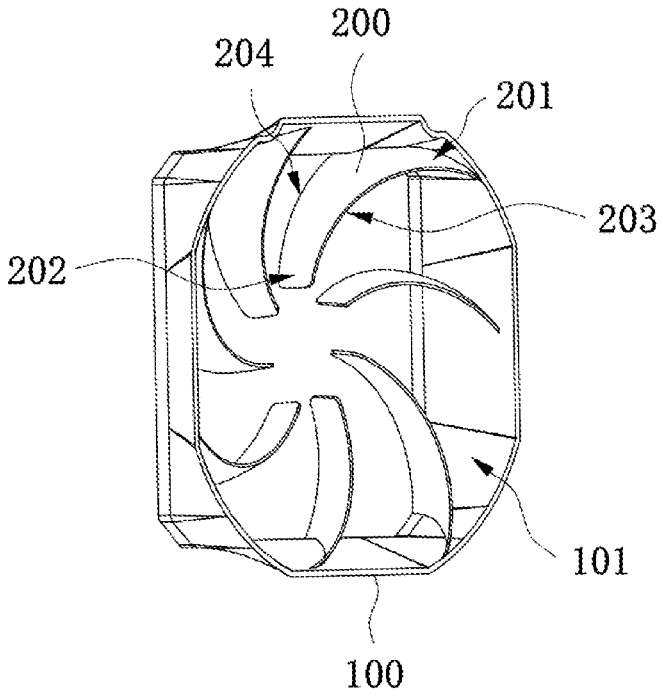
FIG. 4 is an axonometric view of an air guide structure (having seven air guide vanes) according to embodiment one of the present disclosure.
Figure 5:
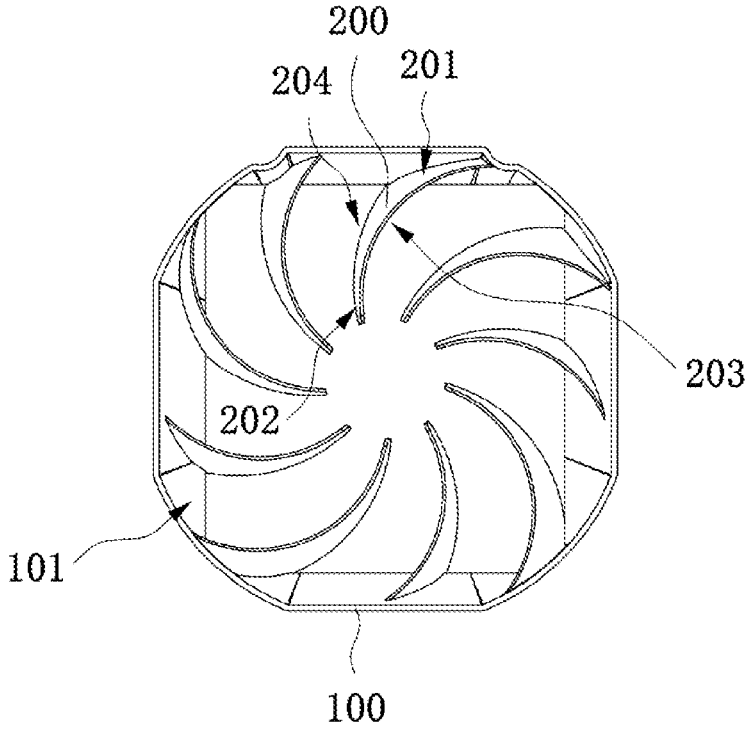
FIG. 5 is a front view of an air guide structure (having nine air guide vanes) according to embodiment one of the present disclosure.
Figure 6:
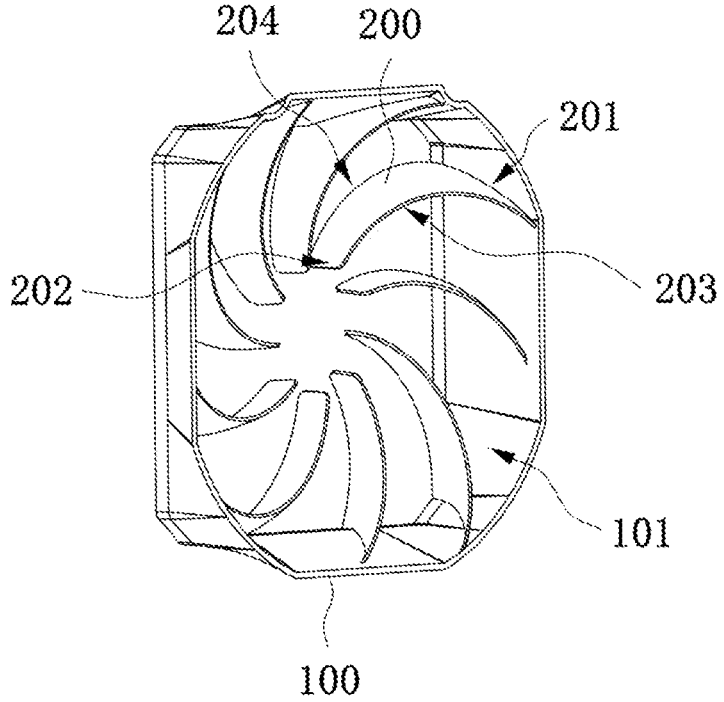
FIG. 6 is an axonometric view of an air guide structure (having nine air guide vanes) according to embodiment one of the present disclosure.
Figure 7:
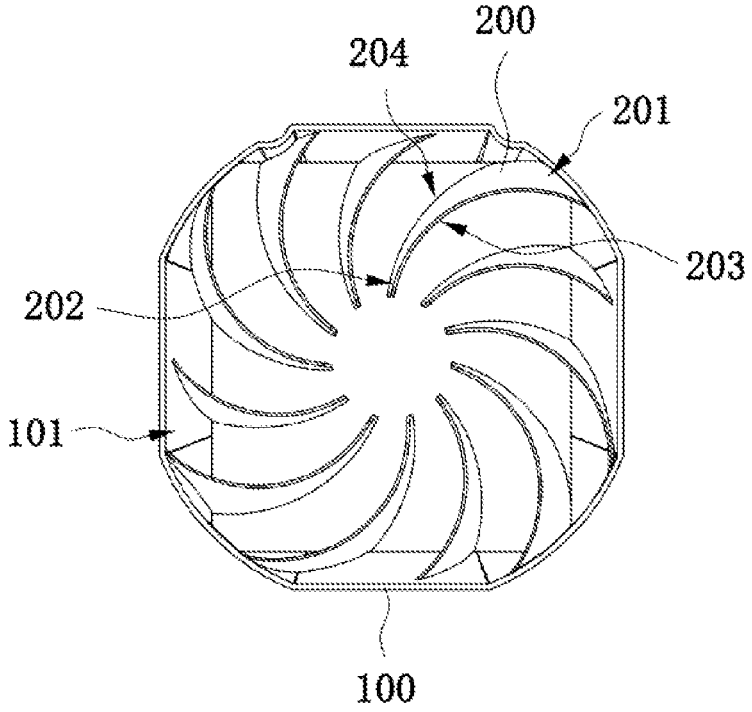
FIG. 7 is a front view of an air guide structure (having eleven air guide vanes) according to embodiment one of the present disclosure.
Figure 8:
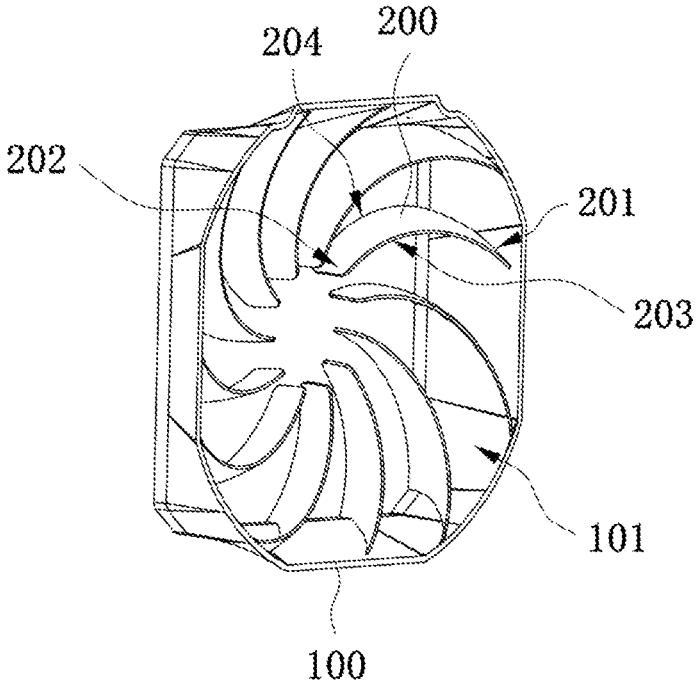
FIG. 8 is an axonometric view of an air guide structure (having eleven air guide vanes) according to embodiment one of the present disclosure.
Figure 9:
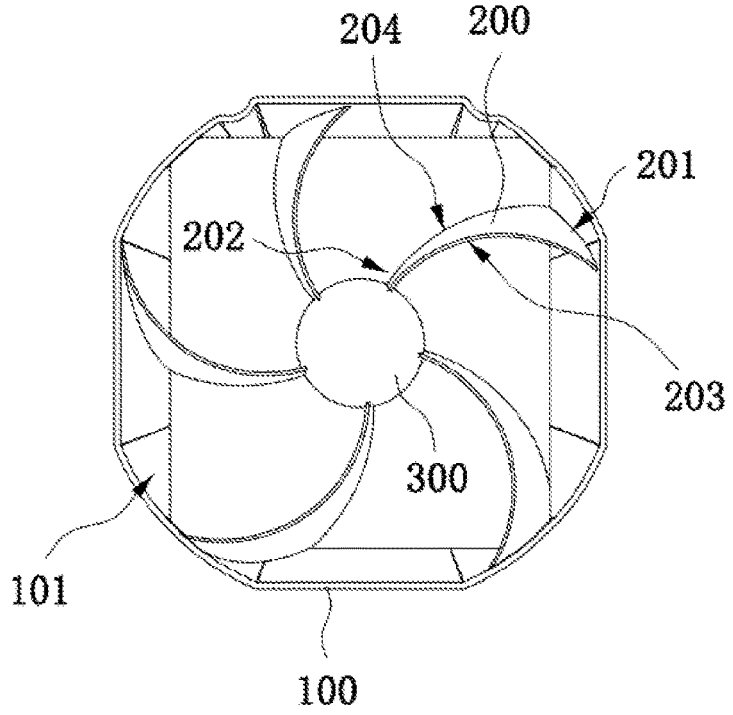
FIG. 9 is a front view of an air guide structure (having five air guide vanes) according to embodiment two of the present disclosure.
Figure 10:
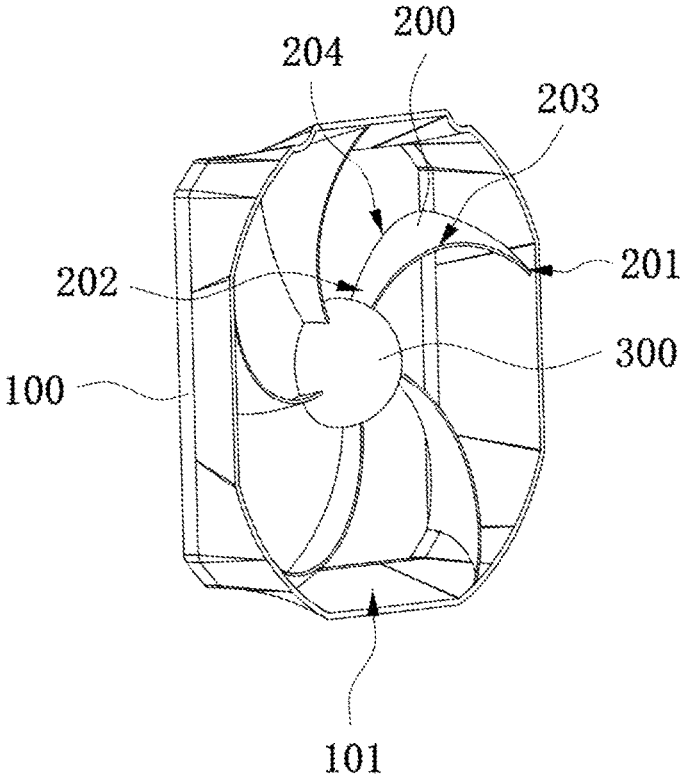
FIG. 10 is an axonometric view of an air guide structure (having five air guide vanes) according to embodiment two of the present disclosure.
Figure 11:
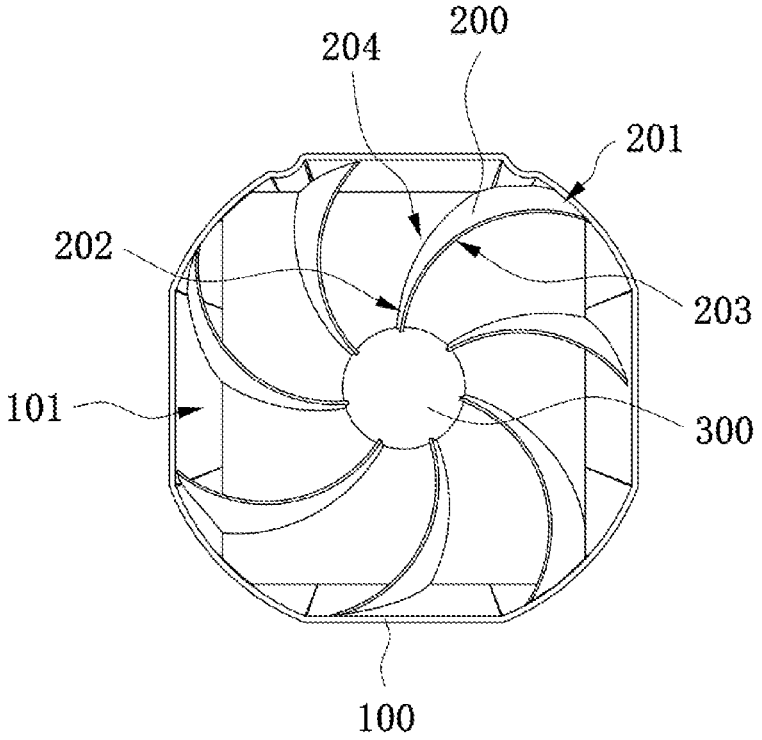
FIG. 11 is a front view of an air guide structure (having seven air guide vanes) according to embodiment two of the present disclosure.
Figure 12:
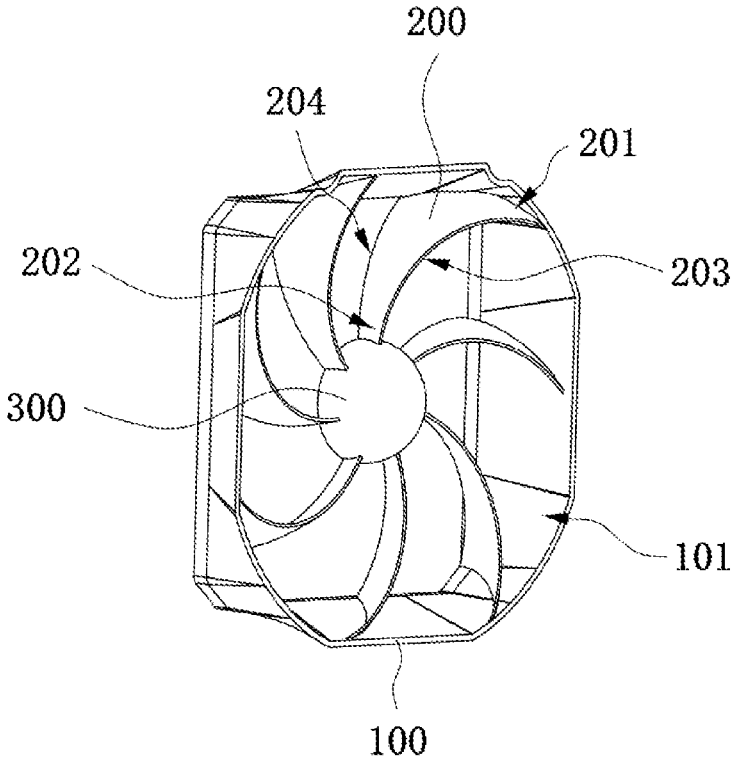
FIG. 12 is an axonometric view of an air guide structure (having seven air guide vanes) according to embodiment two of the present disclosure.
Figure 13:
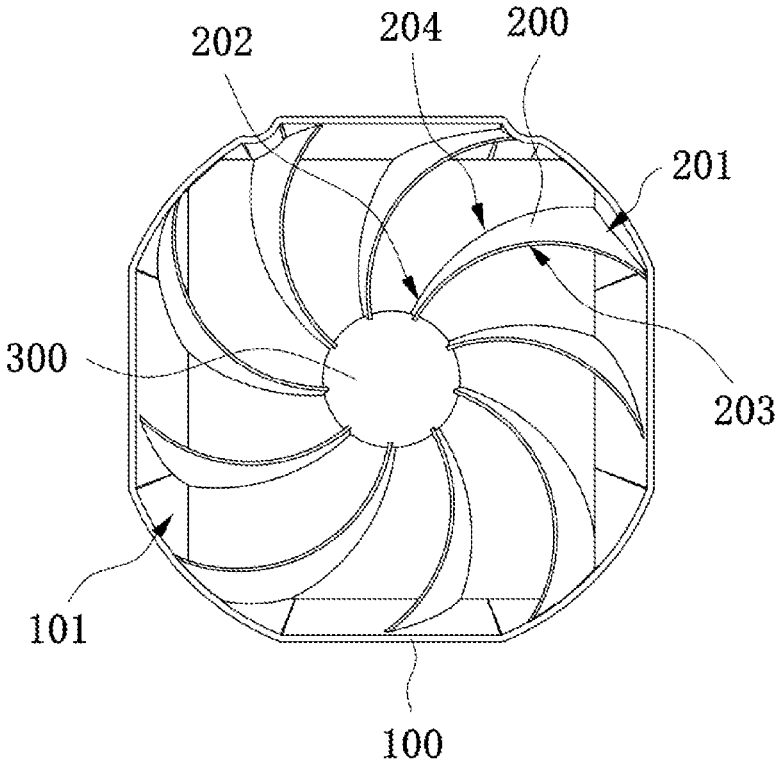
FIG. 13 is a front view of an air guide structure (having nine air guide vanes) according to embodiment two of the present disclosure.
Figure 14:
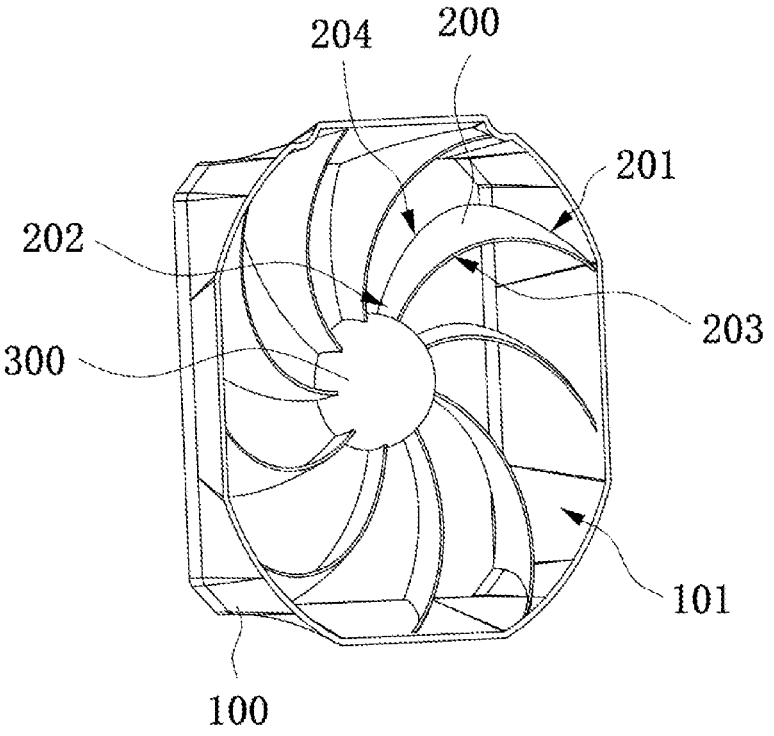
FIG. 14 is an axonometric view of an air guide structure (having nine air guide vanes) according to embodiment two of the present disclosure.
Figure 15:
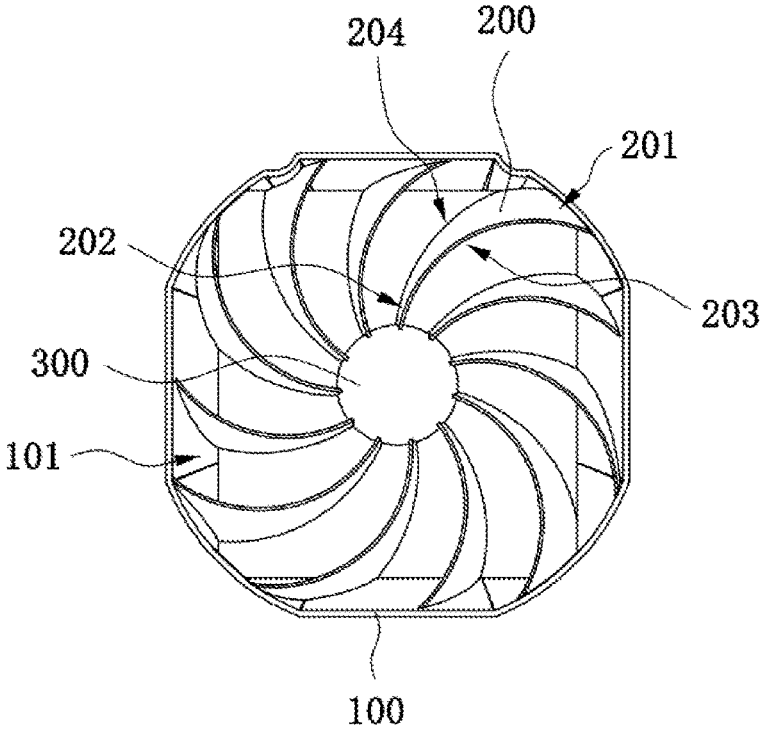
FIG. 15 is a front view of an air guide structure (having eleven air guide vanes) according to embodiment two of the present disclosure.
Figure 16:
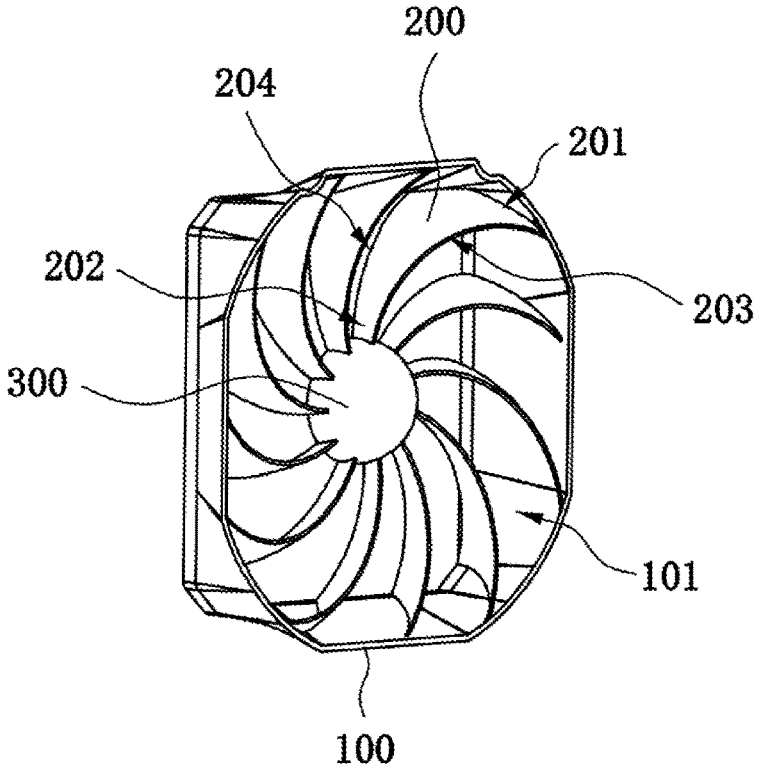
FIG. 16 is an axonometric view of an air guide structure (having eleven air guide vanes) according to embodiment two of the present disclosure.

As shown in FIG. 1 and FIG. 2, the embodiment provides an air guide structure. The air guide structure is disposed between an axial flow fan 600 and a heating body 700. Through the air guide structure, the rotating part of the air blown out by the axial flow fan 600 can be changed, and the rotating air original having an angle of 20° to 70° with the axis of the axial flow fan 600 is corrected to be approximately parallel to the axis of the axial flow fan 600; at this time, the angle of the rotating air with the axis of the axial flow fan 600 is less than 15°. Therefore, it is ensured that more than 90% of the air blown out by the axial flow fan 600 can be blown to the outside of the fan heater, so that the air outlet volume of the whole machine is improved, the air speed is relatively high, and the heating effect is good.

Specifically, the air guide structure in the embodiment includes a frame body 100 and at least three air guide vanes 200, and the at least three air guide vanes 200 are arranged in an annular array on an inner side wall of the frame body 100. Exemplarily, referring to FIG. 3 to FIG. 8, seven air guide vanes 200, nine air guide vanes 200 or eleven air guide vanes 200 may be provided. Apparently, in other embodiments, three air guide vanes 200, five air guide vanes 200 or another number of air guide vanes 200 may be set according to the actual situation, which is not limited in the embodiment.

With continued reference to FIG. 3 to FIG. 8, in the embodiment, each air guide vane 200 includes a fixed end 201, an extended end 202, an air guide vane leading edge 203 and an air guide vane trailing edge 204, the fixed end 201 is disposed on the inner side wall of the frame body 100, the extended end 202 extends along a first arc to the central axis of the frame body 100, a curved surface or multiple sections of planar surfaces are provided between the air guide vane leading edge 203 and the air guide vane trailing edge 204 for transition between the air guide vane leading edge 203 and the air guide vane trailing edge 204, the air guide vane leading edge 203 is parallel to an incoming flow direction of an axial flow fan 600, the air guide vane trailing edge 204 is parallel to an air outlet channel 701 of the heating body 700, and the air guide vane leading edge 203 is inclined to one side relative to the air guide vane trailing edge 204. In this manner, the rotating air generated by the axial flow fan 600 can enter against the air guide vane leading edge 203 of the air guide vane 200 and flow out against the air guide vane trailing edge 204 of the air guide vane 200 and into the air outlet channel 701 of the heating body 700. Therefore, the air guide vane 200 can guide and correct the rotating air and reduce the rotational speed component, so that the rotating air is corrected into the approximately parallel air when entering the heating body 700, and thus the air outlet volume is greatly improved. With the increase of the air outlet volume, the air speed attenuation of the whole machine is weakened, which is beneficial to improving the air speed of the whole machine; thus, the air outlet distance is relative long, the heating range is large, and the heating effect is good.

Further, the air outlet channel 701 of the heating body 700 is surrounded and formed by fins of the heating body 700, and the air blown out after passing the air guide structure is substantially parallel to the fins of the heating body 700, so that the heating body 700 can dissipate heat with no dead spot, and the situation of local overheating is avoided. Therefore, the heating body 700 has relatively high heat dissipation efficiency, so that the problem of local overheating of the heating body 700 is effectively solved, and the service life of the fan heater is extended. In addition, since the rotating air blown out by the axial flow fan 600 is guided to be the approximately parallel air, vortexes near the heating body 700 can be reduced, so that the noise is reduced. Since the air speed is relatively high, under the same heating power, the fan can be used at a reduced rotational speed, so that the noise of the whole machine can be further reduced, bring the good user experience.

In an optional solution, an air guide surface 101 is disposed on the frame body 100, the air guide surface 101 is disposed as a planar surface or a curved surface, and an air outlet end of the air guide surface 101 is parallel to the air outlet channel 701 of the heating body 700. In this manner, the air guide surface 101 can limit the air outlet flow of the whole axial flow fan 600 to the air outlet channel 701 of the heating body 700 to avoid air leakage (that is, the air outlet flow is blown to a place other than the heating body 700). Therefore, the air guide surface 101 of the frame body 100 can also serve as a guiding role, so that most of the air generated by the axial flow fan 600 can enter the heating body 700 and then pass the heating body 700 to be sent out from the whole machine, which is beneficial to improving the air speed and the air volume of the whole machine.

The embodiment further provides a fan heater. As shown in FIG. 1 and FIG. 2, the fan heater includes an axial flow fan 600, a heating body 700 and the preceding air guide structure. The air guide structure is disposed between the axial flow fan 600 and the heating body 700. The axial flow fan 600 includes a mounting frame 610 and a fan. The fan is mounted in the mounting frame 610, and the fan includes a fixed ring 620 and multiple fan blades 630 disposed on the fixed ring 620, each fan blade 630 extends along a second arc to the outside of the fixed ring 620, and the convex direction of the second arc along which the fan blade 630 extends is opposite to the convex direction of the first arc along which the air guide vane 200 extends.

Further, each fan blade 630 includes a fan blade leading edge 631 and a fan blade trailing edge 632, the fan blade leading edge 631 is inclined to one side relative to the fan blade trailing edge 632, and the inclination direction of the fan blade leading edge 631 relative to the fan blade trailing edge 632 is opposite to the inclination direction of the air guide vane leading edge 203 of the air guide vane 200 of the air guide structure relative to the air guide vane trailing edge 204 of the air guide vane 200 of the air guide structure. Through this arrangement, the air guide structure can guide the air generated by the fan to a right direction, thereby reducing the rotational speed component of the rotating air.

More preferably, one side of the frame body 100 of the air guide structure is disposed against the axial flow fan 600, and the frame body 100 is sealingly connected to the axial flow fan 600; the other side of the frame body 100 is disposed against the heating body 700, and the frame body 100 is sealingly connected to the heating body 700. Through this arrangement, the air leakage of the whole machine is avoided, the air outlet volume and the air outlet speed of the whole machine can be further improved, the heating range is expanded, and the heating power of the fan heater is relatively high; moreover, the noise can also be reduced, so that the user experience is improved.

Embodiment Two

The embodiment provides an air guide structure as shown in FIG. 9 to FIG. 16. Compared with the air guide structure in embodiment one, the air guide structure in the embodiment includes a central shaft 300, where the extended end 202 of each air guide vane 200 is fixedly connected to the central shaft 300. Through the central shaft 300, the fixing effect of the air guide vane 200 can be improved to prevent the extended end 202 of the air guide vane 200 from shaking and generating noise when the air speed is relatively high. For example, five air guide vanes 200, seven air guide vanes 200, nine air guide vanes or eleven air guide vanes 200 may be set in the embodiment. Apparently, in other embodiments, three air guide vanes 200, six air guide vanes 200 or another number of air guide vanes 200 may be set according to the actual situation, which is not limited in the embodiment.

The embodiment further provides a fan heater. The fan heater includes an axial flow fan 600, a heating body 700 and the preceding air guide structure. The air guide structure is disposed between the axial flow fan 600 and the heating body 700. The air guide structure includes a frame body 100, air guide vanes 200 and a central shaft 300. A fixed end 201 of each air guide vane 200 is fixed on an air guide surface 101 of the frame body 100, and an extended end 202 of each air guide vane 200 is fixed on the central shaft 300. Through the central shaft 300, the stability of fixing the air guide vane 200 is improved, the structure of the whole air guide structure is stable, the mechanical strength, the tensile strength and the compressive strength are relatively high, and thus the external shock can be resisted. Moreover, the air guide vanes 200 of the air guide structure can guide the air generated by the axial flow fan 600 to a right direction, thereby reducing the rotational speed component of the rotating air. Therefore, the air outlet distance, the air outlet speed and the air outlet volume are improved, the noise is relatively low, and the heating effect is good.

Other structures in the embodiment are the same as the structures in embodiment one. The details are not repeated herein.

Embodiment Three

Figure 17:
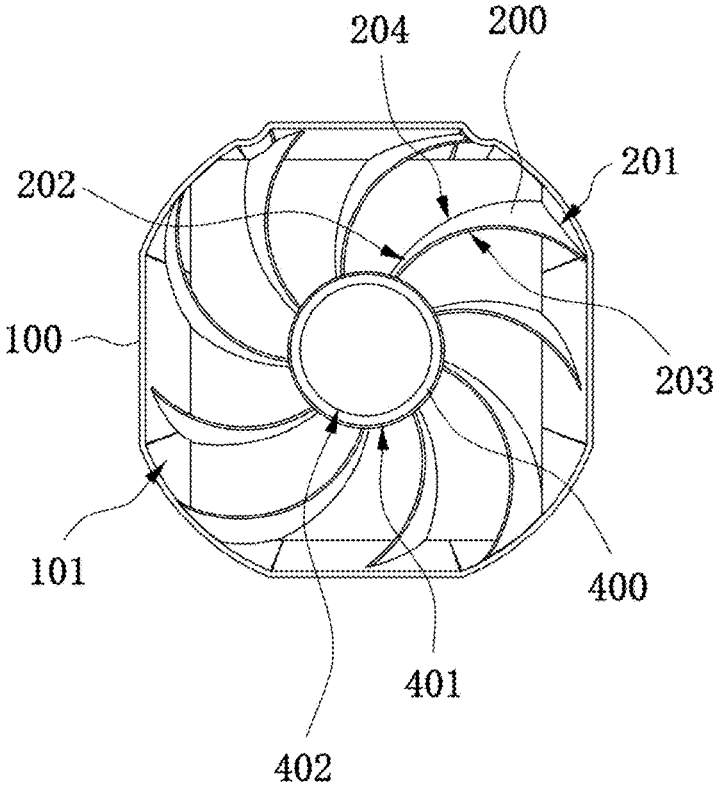
FIG. 17 is a front view of an air guide structure (having nine air guide vanes) according to embodiment three of the present disclosure.
Figure 18:
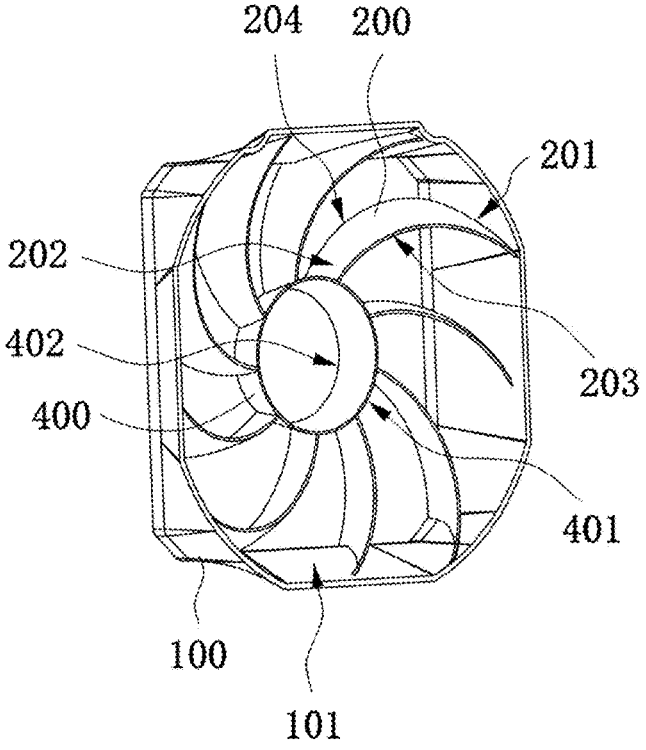
FIG. 18 is an axonometric view of an air guide structure (having nine air guide vanes) according to embodiment three of the present disclosure.

The embodiment provides an air guide structure as shown in FIG. 17 to FIG. 18. Compared with the air guide structure in embodiment one, the air guide structure in the embodiment includes an inner air guide ring 400, where the extended end 202 of each air guide vane 200 is connected to the inner air guide ring 400. Through the inner air guide ring 400, not only the fixing effect of the air guide vane 200 can be improved so that the extended end 202 of the air guide vane 200 is prevented from shaking and generating noise when the air speed is relatively high, but also part of the divergent air blown out by the axial flow fan 600 can be gathered at the axis of the axial flow fan 600 so that the air blown out by the axial flow fan 600 is corrected. Therefore, the air that cannot be blown out originally can be blown to the outside of the fan heater, and thus the air outlet volume of the whole machine is improved; with the increase of the air volume, the air speed attenuation of the whole machine is weakened, so that the air speed of the whole machine is improved, and the better heating effect is achieved.

In an optional solution, nine air guide vanes 200 are taken as an example in the embodiment for illustration. Apparently, in other embodiments, three air guide vanes 200, five air guide vanes 200, seven air guide vanes 200, eleven air guide vanes 200 or another number of air guide vanes 200 may be set according to the actual situation, which is not limited in the embodiment.

In the embodiment, the inner air guide ring 400 includes an inner air guide ring leading edge 401 and an inner air guide ring trailing edge 402, and a curved surface or a planar surface is provided between the inner air guide ring leading edge 401 and the inner air guide ring trailing edge 402 for transition between the inner air guide ring leading edge 401 and the inner air guide ring trailing edge 402. In this manner, part of the air generated by the axial flow fan 600 can enter against the inner air guide ring leading edge 401 of the inner air guide ring 400 and flow out against the inner air guide ring trailing edge 402 of the inner air guide ring 400 and into the air outlet channel 701 of the heating body 700. Through the inner air guide ring 400, part of the divergent air can be corrected to be gathered at the axis of the axial flow fan 600, so that the air speed attenuation of the whole machine is reduced, and thus the air speed of the whole machine is improved to achieve the better heating effect.

The embodiment further provides a fan heater. The fan heater includes an axial flow fan 600, a heating body 700 and the preceding air guide structure. The air guide structure is disposed between the axial flow fan 600 and the heating body 700. The air guide structure includes a frame body 100, air guide vanes 200 and an inner air guide ring 400. A fixed end 201 of each air guide vane 200 is fixed on an air guide surface 101 of the frame body 100, and an extended end 202 of each air guide vane 200 is fixed on the inner air guide ring 400. Through the inner air guide ring 400, the stability of fixing the air guide vane 200 is improved, the structure of the whole air guide structure is stable, the mechanical strength, the tensile strength and the compressive strength are relatively high, and thus the external shock can be resisted. Moreover, the inner air guide ring 400 can gather part of the divergent air generated by the axial flow fan 600, so that the air outlet distance, the air outlet speed and the air outlet volume are further improved, the noise is relatively low, and the heating effect is good.

Other structures in the embodiment are the same as the structures in embodiment one. The details are not repeated herein.

Embodiment Four

Figure 19:
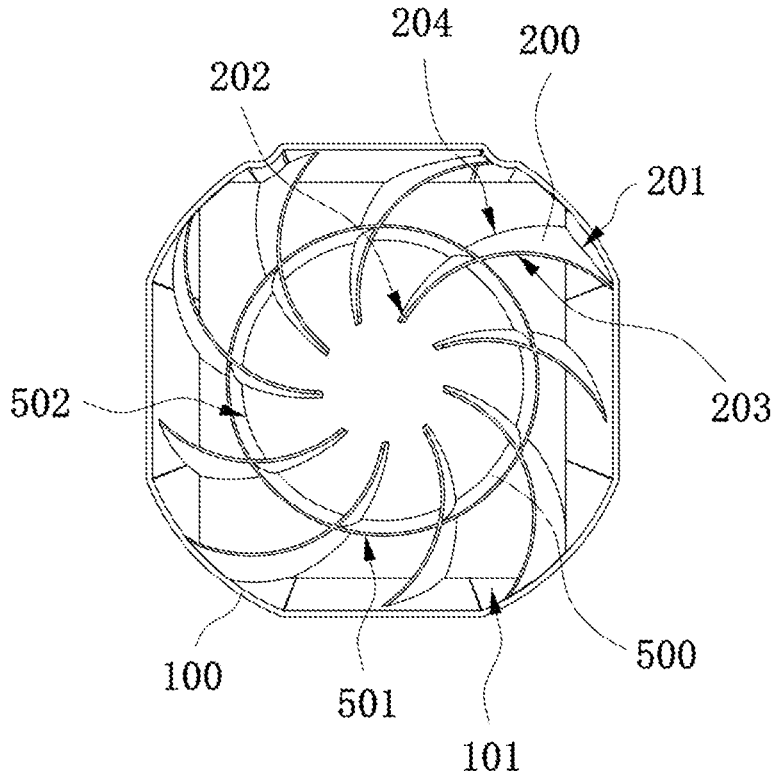
FIG. 19 is a front view of an air guide structure (having nine air guide vanes) according to embodiment four of the present disclosure.
Figure 20:
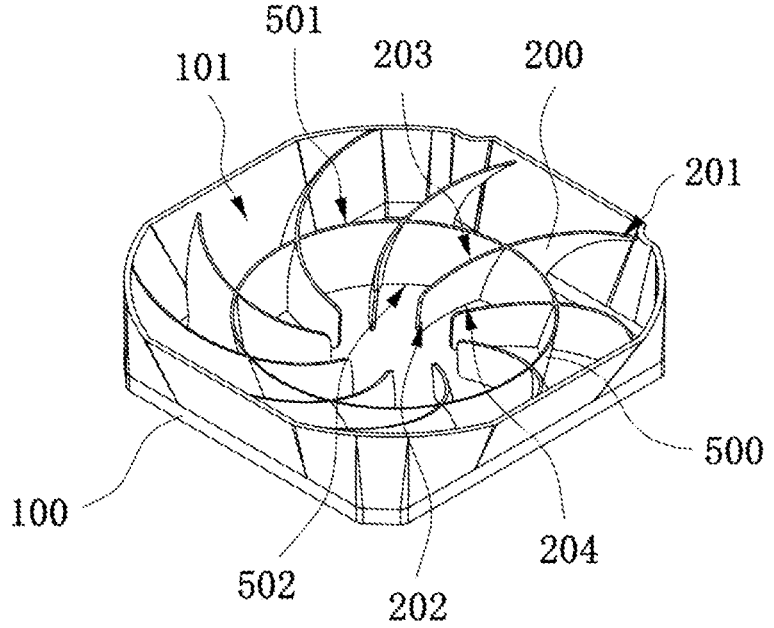
FIG. 20 is an axonometric view of an air guide structure (having nine air guide vanes) according to embodiment four of the present disclosure.

The embodiment provides an air guide structure as shown in FIG. 19 to FIG. 20. Compared with the air guide structure in embodiment one, the air guide structure in the embodiment includes a middle air guide ring 500, and the middle portion of each air guide vane 200 is connected to the middle air guide ring 500. Through the middle air guide ring 500, the fixing effect of the air guide vane 200 can be improved so that the air guide vane 200 is prevented from shaking and generating noise when the air speed is relatively high, and the middle air guide ring 500 can also gather the air blown out by the axial flow fan 600 and further correct the divergent air blown out by the axial flow fan 600 so that the air which cannot be blown out originally can be blown to the outside of the fan heater, thereby increasing the air outlet volume of the whole machine; with the increase of the air volume, the air speed attenuation of the whole machine is weakened, thus the air speed of the whole machine is improved and the better heating effect is achieved.

In an optional solution, nine air guide vanes 200 are taken as an example in the embodiment for illustration. Apparently, in other embodiments, three air guide vanes 200, five air guide vanes 200, seven air guide vanes 200, eleven air guide vanes 200 or another number of air guide vanes 200 may be set according to the actual situation, which is not limited in the embodiment.

In the embodiment, the middle air guide ring 500 includes a middle air guide ring leading edge 501 and a middle air guide ring trailing edge 502, and a curved surface or a planar surface is provided between the middle air guide ring leading edge 501 and the middle air guide ring trailing edge 502 for transition between the middle air guide ring leading edge 501 and the middle air guide ring trailing edge 502. In this manner, part of the air generated by the axial flow fan 600 can enter against the middle air guide ring leading edge 501 of the middle air guide ring 500 and flow out against the middle air guide ring trailing edge 502 of the middle air guide ring 500 and into the air outlet channel 701 of the heating body 700. Through the middle air guide ring 500, part of the divergent air can be corrected, so that the air speed attenuation of the whole machine is further reduced, and thus the air speed of the whole machine is improved to achieve the better heating effect.

The embodiment further provides a fan heater. The fan heater includes an axial flow fan 600, a heating body 700 and the preceding air guide structure. The air guide structure is disposed between the axial flow fan 600 and the heating body 700. The air guide structure includes a frame body 100, air guide vanes 200 and a middle air guide ring 500. A fixed end 201 of each air guide vane 200 is fixed on an air guide surface 101 of the frame body 100, and the middle portion of each air guide vane 200 is fixed on the middle air guide ring 500. Through the middle air guide ring 500, the stability of fixing the air guide vane 200 is improved, the structure of the whole air guide structure is stable, the mechanical strength, the tensile strength and the compressive strength are relatively high, and thus the external shock can be resisted. Moreover, the middle air guide ring 500 can gather part of the divergent air generated by the axial flow fan 600, so that the air outlet distance, the air outlet speed and the air outlet volume are further improved, the noise is relatively low, and the heating effect is good.

Other structures in the embodiment are the same as the structures in embodiment one. The details are not repeated herein.

Embodiment Five

Figure 21:
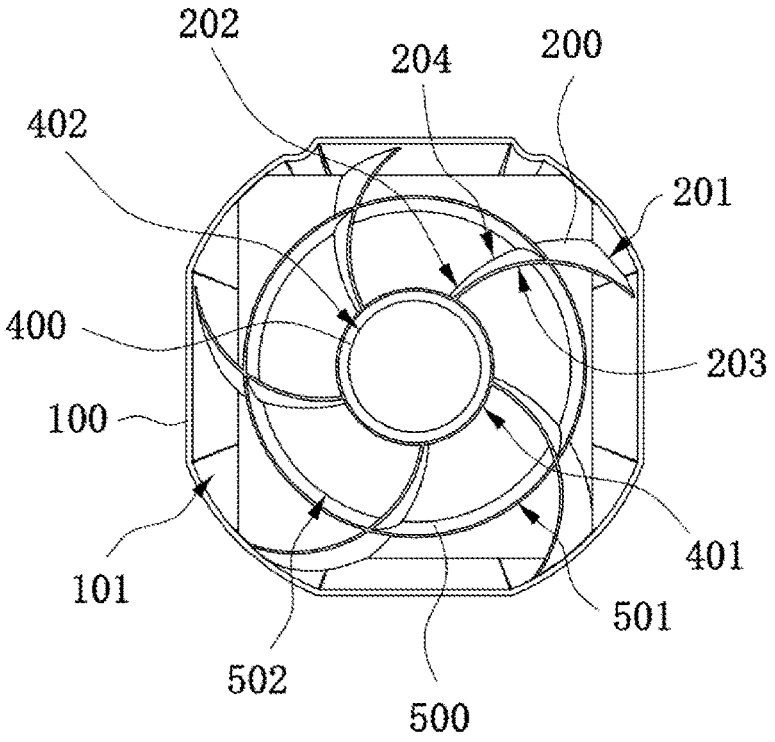
FIG. 21 is a front view of an air guide structure (having five air guide vanes) according to embodiment two of the present disclosure.
Figure 22:
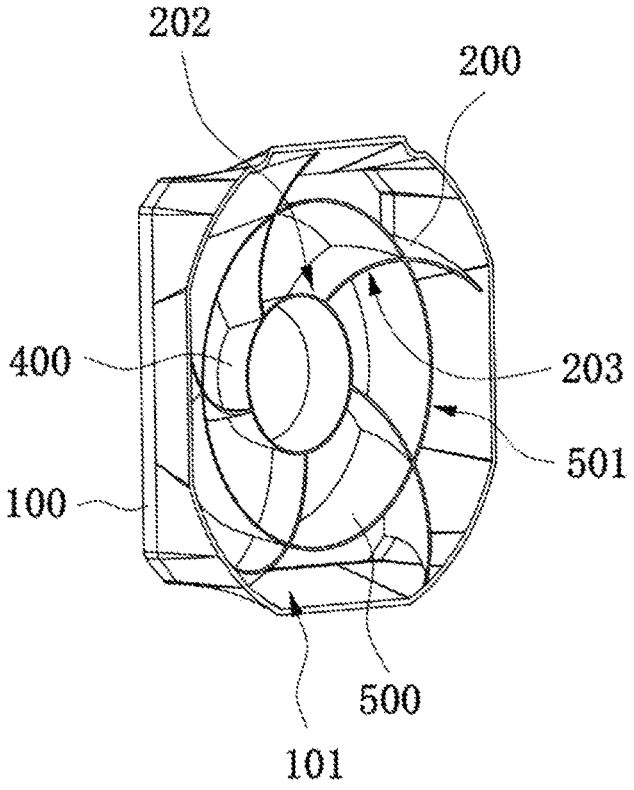
FIG. 22 is an axonometric view of an air guide structure (having five air guide vanes) according to embodiment two of the present disclosure.

The embodiment provides an air guide structure as shown in FIG. 21 to FIG. 22. Compared with the air guide structure in embodiment one, the air guide structure in the embodiment includes an inner air guide ring 400 and a middle air guide ring 500. The extended end 202 of each air guide vane 200 is connected to the inner air guide ring 400, and the middle portion of each air guide vane 200 is connected to the middle air guide ring 500. Through the inner air guide ring 400 and the middle air guide ring 500, the fixing effect of the air guide vane 200 can be improved so that the air guide vane 200 is prevented from shaking and generating noise when the air speed is relatively high, and the inner air guide ring 400 and the middle air guide ring 500 can also gather the air blown out by the axial flow fan 600 and further correct the divergent air blown out by the axial flow fan 600 so that the air which cannot be blown out originally can be blown to the outside of the fan heater, thereby increasing the air outlet volume of the whole machine; with the increase of the air volume, the air speed attenuation of the whole machine is weakened, thus the air speed of the whole machine is improved and the better heating effect is achieved.

In an optional solution, five air guide vanes 200 are taken as an example in the embodiment for illustration. Apparently, in other embodiments, three air guide vanes 200, seven air guide vanes 200, nine air guide vanes 200, eleven air guide vanes 200 or another number of air guide vanes 200 may be set according to the actual situation, which is not limited in the embodiment.

In the embodiment, the inner air guide ring 400 includes an inner air guide ring leading edge 401 and an inner air guide ring trailing edge 402, and a curved surface or a planar surface is provided between the inner air guide ring leading edge 401 and the inner air guide ring trailing edge 402 for transition between the inner air guide ring leading edge 401 and the inner air guide ring trailing edge 402; the middle air guide ring 500 includes a middle air guide ring leading edge 501 and a middle air guide ring trailing edge 502, and a curved surface or a planar surface is provided between the middle air guide ring leading edge 501 and the middle air guide ring trailing edge 502 for transition between the middle air guide ring leading edge 501 and the middle air guide ring trailing edge 502. In this manner, part of the air generated by the axial flow fan 600 can enter against the inner air guide ring leading edge 401 of the inner air guide ring 400 or against the middle air guide ring leading edge 501 of the middle air guide ring 500 and flow out against the inner air guide ring trailing edge 402 of the inner air guide ring 400 or against the middle air guide ring trailing edge 502 of the middle air guide ring 500 and into the air outlet channel 701 of the heating body 700, so that part of the divergent air is corrected, the air speed attenuation of the whole machine is further reduced, and thus the air speed of the whole machine is improved to achieve the better heating effect.

The embodiment further provides a fan heater. The fan heater includes an axial flow fan 600, a heating body 700 and the preceding air guide structure. The air guide structure is disposed between the axial flow fan 600 and the heating body 700. The air guide structure includes a frame body 100, air guide vanes 200, an inner air guide ring 400 and a middle air guide ring 500. A fixed end 201 of each air guide vane 200 is fixed on an air guide surface 101 of the frame body 100, an extended end 202 of each air guide vane 200 is fixed on the inner air guide ring 400, and the middle portion of each air guide vane 200 is fixed on the middle air guide ring 500. Through the inner air guide ring 400 and the middle air guide ring 500, the stability of fixing the air guide vane 200 is improved, the structure of the whole air guide structure is stable, the mechanical strength, the tensile strength and the compressive strength are relatively high, and thus the external shock can be resisted. Moreover, the inner air guide ring 400 and the middle air guide ring 500 can gather part of the divergent air generated by the axial flow fan 600, so that the air outlet distance, the air outlet speed and the air outlet volume are further improved, the noise is relatively low, and the heating effect is good.

Other structures in the embodiment are the same as the structures in embodiment one. The details are not repeated herein.

Apparently, the air guide structure in the preceding embodiments is only shown in a structure form without the central shaft 300, with the central shaft 300, with the inner air guide ring 400, with the middle air guide ring 500 or with a combination of these structure elements, and in other embodiments, the air guide structure including the preceding structure elements is also within the protection scope of the present patent.

In addition, scenes in the embodiment where the air guide structure may be disposed directly on the mounting frame 610 of the axial flow fan 600 without the frame body 100 to form an axial flow fan 600 having the air guide structure, or the air guide structure is combined with the heading body 700 to form a heading body 700 having the air guide structure, or different portions of the air guide structure are integrated with other parts, respectively, for reassembling for use fall within the protection scope of the present patent, and are not listed here one by one.

It is to be noted that in the description of the specification, the description of reference terms such as "some embodiments" and "other embodiments" is intended to mean that specific features, structures, materials or characteristics described in conjunction with such embodiments or examples are included in at least one embodiment or example of the present disclosure. In the specification, the illustrative description of the preceding terms does not necessarily refer to the same embodiment or example. Moreover, the described specific features, structures, materials or characteristics may be combined in an appropriate manner in any one or more embodiments or examples.

What is claimed is:

1. An air guide structure, configured to be disposed between an axial flow fan and a heating body in a fan heater, wherein the air guide structure comprises:

a frame body of the fan heater; and at least three air guide vanes of the fan heater, wherein the at least three air guide vanes are arranged in an annular array, each air guide vane of the three air guide vanes comprises a fixed end, an extended end, an air guide vane leading edge and an air guide vane trailing edge, the fixed end is disposed on an inner side wall of the frame body, the extended end extends along a first arc to a central axis of the frame body, wherein a front surface of each air guide vane configured to face the axial flow fan comprises a curved surface or a plurality of sections of planar surfaces are is provided between the air guide vane leading edge and the air guide vane trailing edge for transition between the air guide vane leading edge and the air guide vane trailing edge, the front surface has tangents that are configured to be parallel to an incoming flow direction of the axial flow fan at all points on the air guide vane leading edge, the front surface has tangents that are configured to be parallel to an extending direction of an air outlet channel of the heating body at all points on the air guide vane trailing edge, and the air guide vane leading edge is inclined to one side relative to the air guide vane trailing edge, wherein an inner cavity is formed inside the frame body of the fan heater, the frame body comprises an air guide surface surrounding the inner cavity, the air guide surface is disposed as a curved surface, the inner cavity is configured to gradually taper in a direction towards the heating body of the fan heater, and an air outlet end of the air guide surface is parallel to the air outlet channel of the heating body extending in a direction from the heating body to the air guide structure, wherein the air guide structure is configured to adjust a direction of air that is blown by the axial flow fan towards the heating body to be in a direction substantially parallel to the air outlet channel of the heating body.

2. The air guide structure according to claim 1, further comprising a central shaft, wherein the extended end of the each air guide vane is connected to the central shaft.

3. The air guide structure according to claim 1, further comprising an inner air guide ring, wherein the extended end of the each air guide vane is connected to the inner air guide ring.

4. The air guide structure according to claim 3, wherein the inner air guide ring comprises an inner air guide ring leading edge and an inner air guide ring trailing edge, and a curved surface or a planar surface is provided between the inner air guide ring leading edge and the inner air guide ring trailing edge for transition between the inner air guide ring leading edge and the inner air guide ring trailing edge.

5. The air guide structure according to claim 1, further comprising a middle air guide ring, wherein a middle portion of the each air guide vane is connected to the middle air guide ring.

6. The air guide structure according to claim 3, further comprising a middle air guide ring, wherein a middle portion of the each air guide vane is connected to the middle air guide ring.

7. The air guide structure according to claim 5, wherein the middle air guide ring comprises a middle air guide ring leading edge and a middle air guide ring trailing edge, and a curved surface or a planar surface is provided between the middle air guide ring leading edge and the middle air guide ring trailing edge for transition between the middle air guide ring leading edge and the middle air guide ring trailing edge.

8. A fan heater, comprising:

an axial flow fan;

a heating body; and an air guide structure, wherein the air guide structure is disposed between the axial flow fan and the heating body, and wherein the air guide structure comprises:

a frame body of the fan heater; and at least three air guide vanes of the fan heater, wherein the at least three air guide vanes are arranged in an annular array, each air guide vane of the three air guide vanes comprises a fixed end, an extended end, an air guide vane leading edge, and an air guide vane trailing edge the fixed end is disposed on an inner side wall of the frame body, the extended end extends along a first arc to a central axis of the frame body, a front surface of each air guide vane facing the axial flow fan comprises a curved surface or a plurality of sections of planar surfaces is provided between the air guide vane leading edge and the air guide vane trailing edge for transition between the air guide vane leading edge and the air guide vane trailing edge, the front surface has tangents parallel to an incoming flow direction of the axial flow fan at all points on the air guide vane leading edge, the front surface has tangents parallel to an extending direction of an air outlet channel of the heating body at all points on the air guide vane trailing edge, and the air guide vane leading edge is inclined to one side relative to the air guide vane trailing edge, wherein an inner cavity is formed inside the frame body of the fan heater, the frame body comprises an air guide surface surrounding the inner cavity, the air guide surface is disposed as a curved surface, the inner cavity gradually tapers in a direction towards the heating body of the fan heater, and an air outlet end of the air guide surface is parallel to the air outlet channel of the heating body extending in a direction from the heating body to the air guide structure, wherein the air guide structure is configured to adjust a direction of air that is blown by the axial flow fan towards the heating body to be in a direction substantially parallel to the air outlet channel of the heating body.

9. The fan heater according to claim 8, wherein the axial flow fan comprises a mounting frame and a fan, the fan comprises a fixed ring and a plurality of fan blades disposed on the fixed ring, the plurality of fan blades extend along a second arc to an outside of the fixed ring, and a convex direction of the second arc is opposite to a convex direction of the first arc; and each fan blade of the plurality of fan blades comprises a fan blade leading edge and a fan blade trailing edge, the fan blade leading edge is inclined to one side relative to the fan blade trailing edge, and an inclination direction of the fan blade leading edge relative to the fan blade trailing edge is opposite to an inclination direction of the air guide vane leading edge of the each air guide vane of the air guide structure relative to the air guide vane trailing edge of the each air guide vane of the air guide structure.

10. The fan heater according to claim 8, wherein one side of the frame body of the air guide structure is disposed against the axial flow fan, the frame body is sealingly connected to the axial flow fan, another side of the frame body is disposed against the heating body, and the frame body is sealingly connected to the heating body.

11. The fan heater according to claim 8, wherein the air guide structure further comprises a central shaft, wherein the extended end of the each air guide vane is connected to the central shaft.

12. The fan heater according to claim 8, the air guide structure further comprises an inner air guide ring, wherein the extended end of the each air guide vane is connected to the inner air guide ring.

13. The fan heater according to claim 12, wherein the inner air guide ring comprises an inner air guide ring leading edge and an inner air guide ring trailing edge, and a curved surface or a planar surface is provided between the inner air guide ring leading edge and the inner air guide ring trailing edge for transition between the inner air guide ring leading edge and the inner air guide ring trailing edge.

14. The fan heater according to claim 8, the air guide structure further comprises a middle air guide ring, wherein a middle portion of the each air guide vane is connected to the middle air guide ring.

15. The fan heater according to claim 12, the air guide structure further comprises a middle air guide ring, wherein a middle portion of the each air guide vane is connected to the middle air guide ring.

16. The fan heater according to claim 14, wherein the middle air guide ring comprises a middle air guide ring leading edge and a middle air guide ring trailing edge, and a curved surface or a planar surface is provided between the middle air guide ring leading edge and the middle air guide ring trailing edge for transition between the middle air guide ring leading edge and the middle air guide ring trailing edge.

* * * * *